US009284689B2

(12) United States Patent
Lam et al.

(10) Patent No.: US 9,284,689 B2
(45) Date of Patent: Mar. 15, 2016

(54) DISPLAY REAR SHELL WITH WATERPROOF AND FIREPROOF PROPERTIES

(71) Applicants: TONGFANG GLOBAL LIMITED, Guangdong Province (CN); SHENYANG TONGFANG MULTIMEDIA TECHNOLOGY CO., LTD., Liaoning Province (CN)

(72) Inventors: Th Lam, Guangdong Province (CN); Wen-Sheng Lu, Guangdong Province (CN); Chih-Ming Huang, Guangdong Province (CN); Tsung-Hsien Chuang, Guangdong Province (CN); Christopher Ng, Guangdong Province (CN)

(73) Assignees: Tongfang Global Limited, Shenzhen, Guangdong Province (CN); Shenyang Tongfang Multimedia Technology Co., Ltd., Shenyang, Liaoning Province (CN)

( * ) Notice: Subject to any disclaimer, the term of this patent is extended or adjusted under 35 U.S.C. 154(b) by 224 days.

(21) Appl. No.: 14/069,599

(22) Filed: Nov. 1, 2013

(65) Prior Publication Data

US 2015/0125705 A1 May 7, 2015

(51) Int. Cl.

| | |
|---|---|
| ***D21H 21/16*** | (2006.01) |
| ***D21H 27/10*** | (2006.01) |
| ***D21H 21/34*** | (2006.01) |

(52) U.S. Cl.

CPC ..... *D21H 21/16* (2013.01); *D21H 21/34* (2013.01); *D21H 27/10* (2013.01); *Y10T 428/31634* (2015.04); *Y10T 428/31993* (2015.04)

(58) Field of Classification Search

CPC ..... D21H 21/16; D21H 27/10; D21H 21/34; Y10T 428/31634; Y10T 428/31993

USPC ..... 428/438, 537.5; 162/135, 137, 159

See application file for complete search history.

(56) References Cited

U.S. PATENT DOCUMENTS

| | | | | |
|---|---|---|---|---|
| 5,618,387 | A * | 4/1997 | Yeh et al. | 162/224 |
| 5,679,433 | A * | 10/1997 | Hayashi et al. | 428/116 |
| 5,863,388 | A * | 1/1999 | Yeh et al. | 162/231 |
| 7,435,483 | B2 * | 10/2008 | Lee et al. | 428/481 |
| 2010/0207300 | A1 * | 8/2010 | Johnson | 264/442 |

* cited by examiner

*Primary Examiner* — Leszek Kiliman

(74) *Attorney, Agent, or Firm* — Rosenberg, Klein & Lee

(57) ABSTRACT

The invention relates to a display rear shell with waterproof and fireproof properties comprising a main layer of a pulp made from hardwood in an amount from 80% to 90% by weight of the main layer, a pulp waterproof composition in an amount from 5% to 15% by weight of the main layer, and a flame retardant in an amount of a remaining weight percentage by weight of the main layer, a fireproof layer and a waterproof layer, in place of a traditional plastic display rear shell using plastic materials for characteristics as waterproof, fireproof and light weight.

15 Claims, 4 Drawing Sheets

DISPLAY REAR SHELL WITH WATERPROOF AND FIREPROOF PROPERTIES

BACKGROUND OF THE INVENTION

1. Fields of the Invention

The present invention relates to a display rear shell with waterproof and fireproof properties, especially to a paper molded shell made by materials as a pulp, pulp waterproof compositions, flame retardants used for paper and so on, on place of a traditional plastic display rear shell using plastic materials for characteristics as waterproof, fireproof and light weight.

2. Descriptions of Related Art

A paper molded product made of pulp has been widely applied in human life, and can be divided into nine categories according to the usage thereof, i.e. (A) shockproof bushings for industrial packaging purposes used in household appliances, devices of glass or ceramic, precision instruments, machinery, and spare parts of motor vehicles and motorcycles or the like, such as a telephones, cell phones, fax machines, microscopes, light bulbs, automotive airbags, motors, car bulbs, senior wine, tea sets, gifts, and handiwork; (B) agricultural trays for holding egg, fruit, etc.; (C) disposable medical supplies, e.g. urinals, bedpans, urine collectors, toilet seats, spittoons, kidney-shaped basins, kidney trays, vomiting pots, and surgical trays; (D) planter products, e.g. nursery cups for flowers and economic crops; (E) furniture sheathes, e.g. side or corner protections for cabinet or painted product; (F) paper molded toys, such as a mask; (G) food containers, such as disposable cutleries or cups; (H) pulp molded sheets, e.g. decorative wall panels; and (I) other products. The above paper molded products have also been successfully applied for many patents, disclosing methods for production thereof, characteristics of buffer strength and natural decomposition in the environment thereof, and structural improvements thereof as required under certain conditions by adding various components or special surface treatment in the production.

LCDs have already become a part of human life for use in computers, TVs or other electronic products, and the sizes thereof generally get larger with development of processes; in other words, the larger size a screen requires, the heavier the LCD is. In such a case, not only do moving and installing the LCD become difficult, but also the LCD having a panel will be subject to severe damages in incidents or events resulted from earthquakes or other force majeure. Therefore, in order to improve effectively the aforesaid shortcomings of the conventional plastic display rear shell and effectively add the waterproof and fireproof characteristics in a rear shell, the persons skilled in this art still need to endeavor overcoming and resolving the aforesaid issues in development of LCDs.

SUMMARY OF THE INVENTION

It is a primary object of the present invention to provide a display rear shell with waterproof and fireproof properties, especially to a paper molded shell made by materials as a pulp, pulp waterproof compositions, flame retardants used for paper and so on, in place of a traditional plastic display rear shell using plastic materials for characteristics as waterproof, fireproof and light weight.

In order to achieve the above object, a display rear shell with waterproof and fireproof properties in the present invention comprises a main layer, a fireproof layer and a waterproof layer; wherein the main layer includes a pulp made from hardwood in an amount from 80% to 90% by weight of the main layer, a pulp waterproof composition comprising a waterproof agent and a glue in an amount from 5% to 15% by weight of the main layer, wherein the waterproof agent having a PH value ranging from 7 to 9 is in an amount from 5% to 8% by weight of the pulp waterproof composition, a glue in an amount of a remaining weight percentage by weight of the pulp waterproof composition, and the waterproof agent further comprises a synthetic beeswax in an amount from 25% to 35% by weight thereof; and a flame retardant in an amount of a remaining weight percentage by weight of the main layer. The flame retardant is a phosphorus flame retardant, a halogenated flame retardant, an alumina hydrated flame retardant, a borax flame retardant or combination thereof.

The fireproof layer made of an inorganic fiber is disposed on the main layer of the display rear shell by spraying or roller coating techniques, and the inorganic fiber includes asbestos, mineral wool, and fiberglass.

The waterproof layer is disposed on the fireproof layer by spraying or roller coating of the pulp waterproof composition over the surface of the fireproof layer and drying of the same by a dryer.

The pulp is made from various tree species having different fiber properties for further manufacturing of various kinds of paper, e.g. *eucalyptus* pulp, low vessel picking pulp, bulky pulp, high opacity pulp or combination thereof.

The flame retardant can be a high effective flame retardant, preferably ammonium polyphosphate (APP).

In addition, a method for a display rear shell with waterproof and fireproof properties includes a plurality of steps. First, mix a pulp, a pulp waterproof composition, and a flame retardant to form a concentrated pulpiness as an essential raw material for manufacturing of the main layer of the display rear shell, wherein the main layer includes a pulp made from hardwood in an amount from 80% to 90% by weight of the main layer; a pulp waterproof composition in an amount from 5% to 15% by weight of the main layer, and a flame retardant in an amount of a remaining weight percentage by weight of the main layer. Then, fill the concentrated pulpiness into a mold, and press it to form the main layer of the display rear shell. Finally, dry the main layer to obtain a finished product of a display rear shell with waterproof and fireproof properties.

In an embodiment of the present invention, a fireproof layer made of an inorganic fiber can be disposed on the main layer of the display rear shell by spraying or roller coating techniques after drying the main layer, and the inorganic fiber includes asbestos, mineral wool, and fiberglass.

Further, a waterproof layer can be disposed on the fireproof layer by spraying or roller coating of the pulp waterproof composition over the surface of the fireproof layer, wherein the pulp waterproof composition comprises a waterproof agent having a PH value ranging from 7 to 9 in an amount from 5% to 8% by weight thereof and a glue in an amount of a remaining weight percentage by weight thereof, and the waterproof agent further comprises a synthetic beeswax in an amount from 25% to 35% by weight thereof.

Accordingly, addition of a high effective flame retardant of Ammonium Polyphosphate into a pulp, and spraying or roller coating of a fireproof agent made of an inorganic fiber such as asbestos, mineral wool, and fiberglass over a main layer surface of a display rear shell to form a fireproof layer in the present invention are able to achieve the fireproof property of a paper molded product. Also, addition into a pulp of a pulp waterproof composition composed of a waterproof agent having a synthetic beeswax and a paste, or glue, and uniformly spraying or roller coating of the pulp waterproof composition over the surface of the aforesaid fireproof layer to form a waterproof layer are able to achieve the waterproof property of a paper molded product. On the other hand, the display rear shell in the present invention can be properly installed on a large-size display to overcome disadvantages of a conventional paper molded product as above mentioned in prior art.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
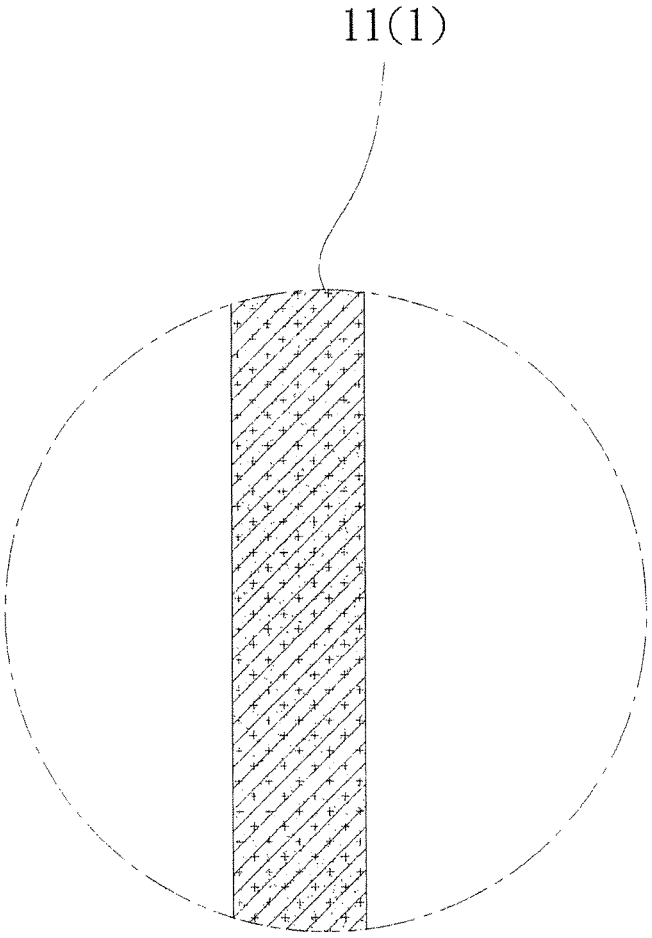
FIG. 1 is a cross-sectional view showing structure of an embodiment of a display rear shell according to the present invention.
Figure 3:
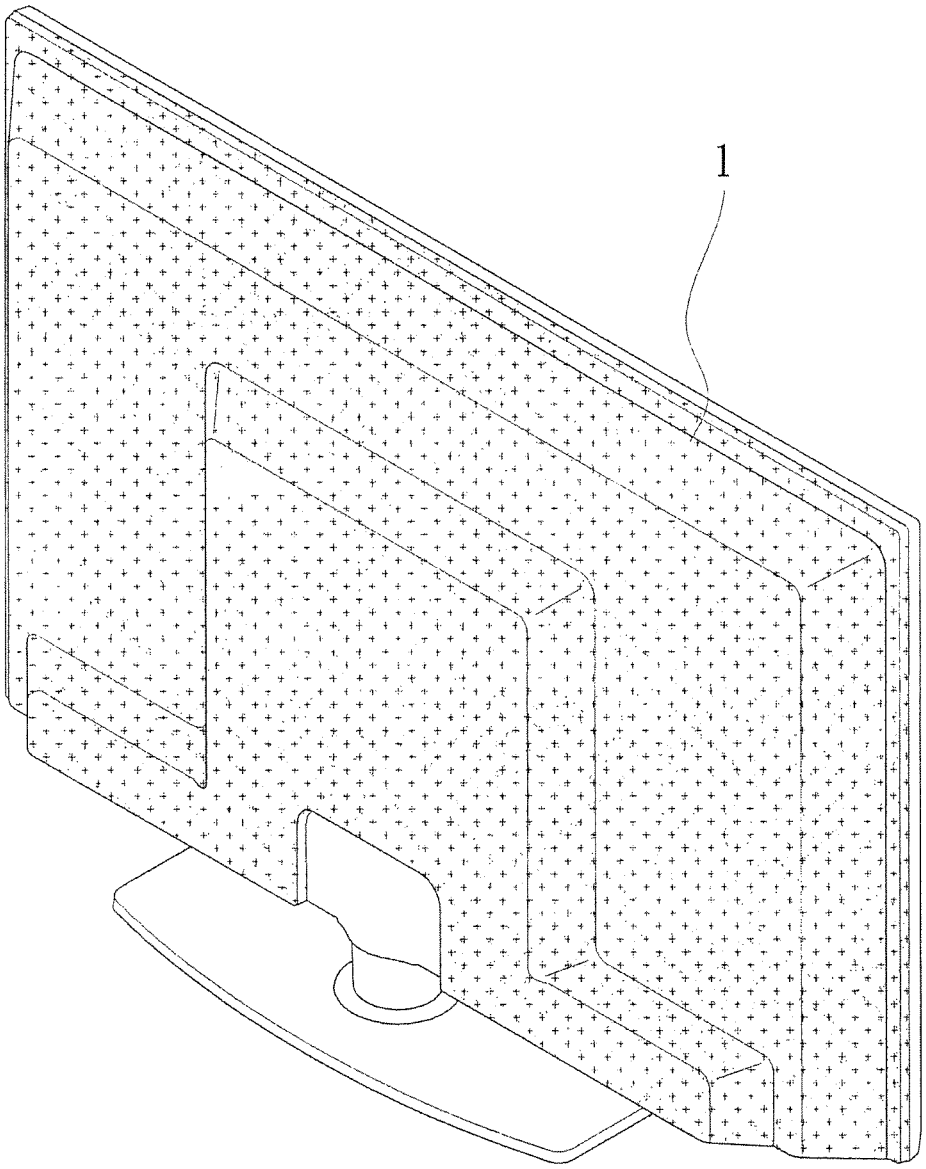
FIG. 3 is a three-dimensional appearance view showing structure of another embodiment of a display rear shell according to the present invention.

First, please refer to FIG. 1, a cross-sectional view showing structure of an embodiment of a display rear shell according to the present invention, and also refer to FIG. 3, a three-dimensional appearance view showing structure of another embodiment of a display rear shell according to the present invention. A display rear shell 1 with waterproof and fireproof properties comprises a main layer 11 having a pulp in an amount from 80% to 90% by weight of the main layer 11, a pulp waterproof composition in an amount from 5% to 15% by weight of the main layer 11 and a flame retardant in an amount of a remaining weight percentage by weight of the main layer 11, wherein the pulp made from hardwood chip, wherein the pulp is used of fiber properties of different species to manufacture the pulp suited to different kinds of paper, it is *eucalyptus* pulp, low vessel picking pulp, bulky pulp, and high opacity pulp or combination thereof.

the pulp waterproof composition comprises a waterproof agent having a PH value ranging from 7 to 9 in an amount from 5% to 8% by weight of the pulp waterproof composition and a glue in an amount of a remaining weight percentage by weight of the pulp waterproof composition, wherein the waterproof agent comprises a synthetic beeswax in an amount from 25% to 35% by weight thereof.

the flame retardant, also known as fire retardant, is a phosphorus flame retardant, a halogenated flame retardant, an alumina hydrated flame retardant, a borax flame retardant or combination thereof, where there are many varieties of the phosphorus flame retardant used in a flame retardant, the phosphorus flame retardant used firstly in the paper industry is ammonium phosphate, and the widespread used currently is an effective flame retardant of ammonium polyphosphate developed in recent years, wherein the ammonium polyphosphate is a high quality, effective, and nontoxic inorganic flame retardant, and is a necessary additive agent of a fire retardant in a variety of intumescent fireproof coatings and fire retardant products.

Figure 2:
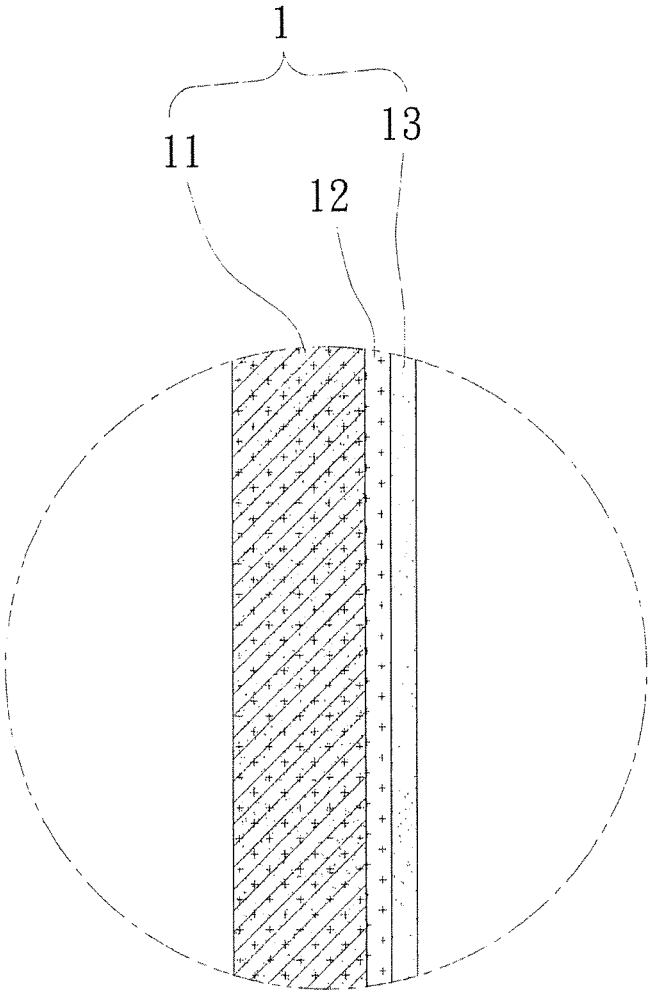
FIG. 2 is a cross-sectional view showing structure of another embodiment of a display rear shell according to the present invention.

In addition, please refer to FIG. 2, a cross-sectional view showing structure of another embodiment of a display rear shell according to the present invention, wherein a fireproof layer 12 made of an inorganic fiber is disposed on the surface of the main layer 11 in the display rear shell 1 by spraying or roller coating techniques. The inorganic fiber includes asbestos, mineral wool, and fiberglass. A waterproof layer 13 is further disposed on the fireproof layer 12 by spraying or roller coating of the pulp waterproof composition over the surface of the fireproof layer 12 and drying of the same by a dryer.

Figure 4:
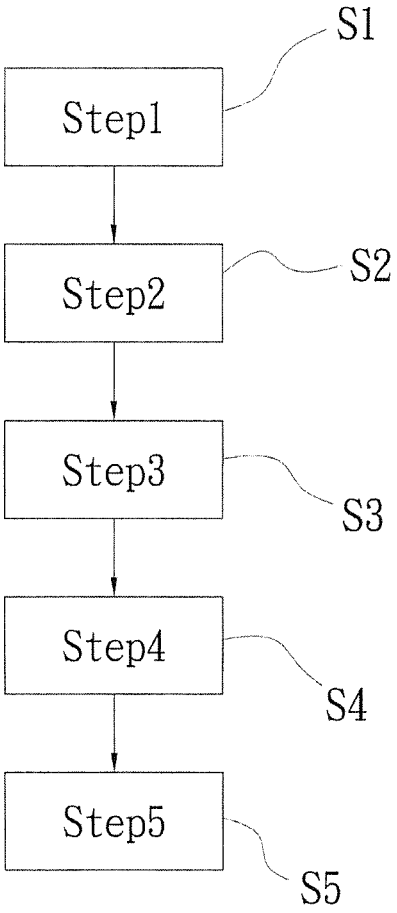
FIG. 4 is a flow chart showing steps of another embodiment of a display rear shell according to the present invention.

Please refer to FIG. 4, a flow chart showing steps of another embodiment of a display rear shell including following steps according to the present invention is revealed.

Step one (S1): mix a pulp, a pulp waterproof composition, and a flame retardant to form a concentrated pulpiness as an essential raw material for production of a main layer 11 of the display rear shell 1, wherein the main layer 11 includes a pulp made from hardwood in an amount from 80% to 90% by weight of the main layer 11, a pulp waterproof composition in an amount from 5% to 15% by weight of the main layer 11, and a flame retardant in an amount of a remaining weight percentage by weight of the main layer 11.

Step two (S2): Fill the concentrated pulpiness into a mold, and press it to form the main layer 11 of the display rear shell 1.

Step three (S3): Dry the main layer 11 of the display rear shell 1 for finished product of a display rear shell 1 with waterproof and fireproof properties.

In addition, further includes a step four (S4) of spraying or roller coating a fireproof layer 12 made of an inorganic fiber on the main layer 11 of the display rear shell 1 after drying the main layer 11, and the inorganic fiber includes asbestos, mineral wool, and fiberglass.

Furthermore, further includes a step five (S5) of disposing a waterproof layer 13 on the fireproof layer 12 by spraying or roller coating of the pulp waterproof composition over the surface of the fireproof layer 12.

In addition, by the following description of a practical embodiment to further demonstrate the practical application range of the process from the present invention, but the range of the present invention is not limited in any way.

First, the main layer 11 includes a pulp in an amount of 90% by weight of the main layer 11, a pulp waterproof composition of 5% by weight of the main layer 11, and a flame retardant of 5% by weight of the main layer 11 and forms a concentrated pulpiness as an essential raw material for production of a main layer 11 of the display rear shell. The pulp waterproof composition has a PH value 8.2 in an amount of 6% by weight of the pulp waterproof composition and a glue in an amount of 94% by weight of the pulp waterproof composition, wherein the waterproof agent comprises a synthetic beeswax in an amount of 30% by weight thereof. The flame retardant is an effective flame retardant of ammonium polyphosphate. Then, filling above concentrated pulpiness into a mold, and pressing it to form the main layer 11 of the display rear shell 1. After drying the main layer 11 of the display rear shell 1, spraying or roller coating a fireproof layer 12 made of an inorganic fiber on the main layer 11 of the display rear shell 1. Final, disposing a waterproof layer 13 on the fireproof layer 12 by spraying or roller coating of the pulp waterproof composition over the surface of the fireproof layer 12. In the refractory experiment with 1000° C. fire temperature and 30 cm distance from the fire, the display rear shell 1 is nonflammable. In the water resistant experiment with putting the display rear shell 1 in water for one hour at room temperature, the test result shows that the water absorption is lower 5%. In addition, the weight of the display rear shell 1 manufactured by the embodiment is approximately lighter 20% than traditional plastic display rear shell 1 using plastic materials.

In summary, a display rear shell with waterproof and fireproof properties according to the present invention has following advantages compared with techniques available now:

1. The display rear shell with waterproof and fireproof properties of the present invention adds into a high effective flame retardant of ammonium polyphosphate into a pulp, and spraying or roller coating of a fireproof agent made of an inorganic fiber such as asbestos, mineral wool, and fiberglass over a main layer surface of a display rear shell to form a fireproof layer in the present invention are able to achieve the fireproof property of a paper molded product.

2. The display rear shell with waterproof and fireproof properties of the present invention adds into a pulp of a pulp waterproof composition composed of a waterproof agent having a synthetic beeswax and a paste, or glue, and uniformly spraying or roller coating of the pulp waterproof composition over the surface of the aforesaid fireproof layer to form a waterproof layer are able to achieve the waterproof property of a paper molded product.

3. The display rear shell in the present invention can be properly installed on a large-size display to overcome disadvantages of a conventional paper molded product as above mentioned in prior art.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display rear shell with waterproof and fireproof properties comprising: a main layer having a pulp in an amount from 80% to 90% by weight of the main layer, a pulp waterproof composition in an amount from 5% to 15% by weight of the main layer, and a flame retardant in an amount of a remaining weight percentage by weight of the main layer, wherein:

the pulp is made from hardwood;

the pulp waterproof composition comprises a waterproof agent having a PH value ranging from 7 to 9 in an amount from 5% to 8% by weight of the pulp waterproof composition and a glue in an amount of a remaining weight percentage by weight of the pulp waterproof composition, wherein the waterproof agent comprising a synthetic beeswax in an amount from 25% to 35 wt. % by weight thereof; and the flame retardant is a phosphorus flame retardant, a halogenated flame retardant, an alumina hydrated flame retardant, a borax flame retardant or combination thereof, and wherein said display rear shell comprises a rear shell of an LCD display panel.

2. The display rear shell as claimed in claim 1, wherein a fireproof layer made of an inorganic fiber is further disposed on the surface of the display rear shell by spraying or roller coating techniques.

3. The display rear shell as claimed in claim 2, wherein the inorganic fiber includes asbestos, mineral wool, and fiberglass.

4. The display rear shell as claimed in claim 2, wherein a waterproof layer is further disposed on the fireproof layer by spraying or roller coating of the pulp waterproof composition over the surface of the fireproof layer and drying of the same by a dryer.

5. The display rear shell as claimed in claim 1, wherein the pulp is a *eucalyptus* pulp, low vessel picking pulp, bulky pulp, and high opacity pulp or combination thereof.

6. The display rear shell as claimed in claim 1, wherein the flame retardant is a high effective flame retardant of ammonium polyphosphate (APP).

7. A method for manufacturing a display rear shell with waterproof and fireproof properties comprising the steps of:

step one: mixing a pulp, a pulp waterproof composition, and a flame retardant to form a concentrated pulpiness as an essential raw material for production of a main layer of the display rear shell, wherein the main layer includes a pulp made from hardwood in an amount from 80% to 90% by weight of the main layer, a pulp waterproof composition in an amount from 5% to 15% by weight of the main layer, and a flame retardant in an amount of a remaining weight percentage by weight of the main layer;

step two: filling the concentrated pulpiness into a mold, and pressing it to form the main layer of the display rear shell; and step three: drying the main layer of the display rear shell for finished product of a display rear shell with waterproof and fireproof properties and, wherein said mold forms a rear shell of an LCD display panel.

8. The method as claimed in claim 7, further including a step of spraying or roller coating a fireproof layer made of an inorganic fiber on the main layer of the display rear shell after drying the main layer.

9. The method as claimed in claim 8, wherein the inorganic fiber includes asbestos, mineral wool, and fiberglass.

10. The method as claimed in claim 8, further including a step of disposing a waterproof layer on the fireproof layer by spraying or roller coating of the pulp waterproof composition over the surface of the fireproof layer.

11. The method as claimed in claim 7, wherein the pulp is *eucalyptus* pulp, low vessel picking pulp, bulky pulp, and high opacity pulp or combination thereof.

12. The method as claimed in claim 7, wherein the pulp waterproof composition is composed of a waterproof agent having a PH value ranging from 7 to 9 in an amount from 5% to 8% by weight of the pulp waterproof composition and a glue in an amount of a remaining weight percentage by weight of the pulp waterproof composition, wherein the waterproof agent comprising a synthetic beeswax in an amount from 25% to 35% by weight thereof.

13. The method as claimed in claim 10, wherein the pulp waterproof composition is composed of a waterproof agent having a PH value ranging from 7 to 9 in an amount from 5% to 8% by weight of the pulp waterproof composition and a glue in an amount of a remaining weight percentage by weight of the pulp waterproof composition, wherein the waterproof agent comprising a synthetic beeswax in an amount from 25% to 35% by weight thereof.

14. The method as claimed in claim 7, wherein the flame retardant is a phosphorus flame retardant, a halogenated flame retardant, an alumina hydrated flame retardant, a borax flame retardant or combination thereof.

15. The method as claimed in claim 14, wherein the flame retardant is a high effective flame retardant of ammonium polyphosphate (APP).

* * * * *